US007363897B2

(12) United States Patent
Fischer et al.

(10) Patent No.: US 7,363,897 B2
(45) Date of Patent: Apr. 29, 2008

(54) VANE-TYPE CAM PHASER HAVING BIAS SPRING SYSTEM TO ASSIST INTERMEDIATE POSITION PIN LOCKING

(75) Inventors: Thomas H. Fischer, Rochester, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/639,530

(22) Filed: Dec. 15, 2006

(65) Prior Publication Data

US 2007/0277758 A1 Dec. 6, 2007

Related U.S. Application Data

(63) Continuation-in-part of application No. 11/447,437, filed on Jun. 6, 2006.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,276,321 B1 * 8/2001 Lichti et al. ..... 123/90.17

* cited by examiner

*Primary Examiner*—Zelalem Eshete
(74) *Attorney, Agent, or Firm*—Michael D. Smith

(57) ABSTRACT

A vane-type camshaft phaser for varying the timing of combustion valves in an internal combustion engine. The phaser includes a seat formed in the sprocket at the appropriate position of intermediate rotor rotation and a locking pin slidably disposed in a vane of the rotor for engaging the seat to lock the rotor to the stator at the intermediate position. A bias spring system disposed on a cover plate urges the rotor toward the intermediate locking position from any position retarded of the locking position but does not engage the rotor during valve timing-advance motion thereof from the intermediate locking position.

3 Claims, 4 Drawing Sheets

VANE-TYPE CAM PHASER HAVING BIAS SPRING SYSTEM TO ASSIST INTERMEDIATE POSITION PIN LOCKING

RELATIONSHIP TO OTHER APPLICATIONS AND PATENTS

The present application is a Continuation-In-Part of a pending U.S. patent application Ser. No. 11/447,437, filed Jun. 6, 2006.

TECHNICAL FIELD

The present invention relates to vane-type camshaft phasers for varying the phase relationship between crankshafts and camshafts in internal combustion engines; more particularly, to such phasers wherein a locking pin assembly is utilized to lock the phaser rotor with respect to the stator at certain times in the operating cycle; and most particularly, to a phaser that utilizes applied torque between a sprocket and a rotor to assist a lock pin in locking the rotor at a rotational position intermediate between full phaser advance and full phaser retard positions.

BACKGROUND OF THE INVENTION

Camshaft phasers for varying the phase relationship between the crankshaft and a camshaft of an internal combustion engine are well known. A prior art vane-type phaser generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve (OCV), in accordance with an engine control module, to either the advance or retard chambers as required to meet current or anticipated engine operating conditions.

In a typical prior art vane-type cam phaser, a controllably variable locking pin is slidingly disposed in a bore in a rotor vane to permit rotational locking of the rotor to a locking pin seat in the stator (or sprocket wheel or pulley) under certain conditions of operation of the phaser and engine. In older prior art phasers, it is desired that the rotor be locked at an extreme of the rotor authority, typically at the full retard position. To assist in positioning the rotor, it is known to incorporate a mechanical stop for the rotor and a torsional bias spring acting between the rotor and the stator to urge the rotor against the stop at the desired position for locking. Such desired position is typically at full phaser retard.

In newer prior art phasers, it is desirable that the rotor be lockable to the stator at an intermediate position in an increased rotor range of rotational authority. A known problem in such phasers is that there is no mechanical means such as a stop to assist in positioning the rotor for locking in an intermediate position; thus, locking is not reliable, and an unacceptably high rate of locking failures may occur.

What is needed in the art of phasers requiring an intermediate lock pin angle is mechanical means to advance the cam timing angle from full retard to align the lock pin with a mid-range pin seat when oil pressure is low.

It is a principal object of the present invention to cause a rotor lock pin to be properly positioned for engagement with a stator at a mid-point of the rotor's range of authority.

SUMMARY OF THE INVENTION

Briefly described, a vane-type camshaft phaser in accordance with the invention for varying the timing of combustion valves in an internal combustion engine includes a rotor having a plurality of vanes disposed in a stator having a plurality of lobes, the interspersion of vanes and lobes defining a plurality of alternating valve timing advance and valve timing retard chambers with respect to the engine crankshaft. The rotational authority of the rotor within the stator with respect to top-dead-center of the crankshaft is preferably between about 40 crank degrees before TDC (valve timing advanced) and about 30 crank degrees after TDC (valve timing retarded). It is generally desirable that an engine be started under an intake phaser position of about 10 crank degrees valve retard. Thus, an improved phaser in accordance with the present invention includes a pin seat formed in the stator at the appropriate position of intermediate rotation and a locking pin slidably disposed in a vane of the rotor for engaging the seat to lock the rotor at the intermediate position. An exemplary prior art locking pin means suitable for use in a camshaft phaser in accordance with the invention is disclosed in U.S. Pat. No. 6,948,467, the relevant disclosure of which is incorporated herein by reference.

A toroidal spring disposed on the phaser cover plate is grounded to the stator and is variably grounded to the rotor. When the rotor is moving in a phase-advance direction, at or near the rotor locking position the bias spring becomes disengaged from the rotor, and the rotor thus moves without spring restraint. When the rotor is moving in a phase-retard direction, at or near the rotor locking position the bias spring becomes engaged, causing the rotor to decelerate and thereby increase the reliability of locking at the intermediate position. The phase angle will tend to oscillate about the interemediate position with each torque reversal typical of each valve event. Therefore, the lock pin will pass over its seat with each such oscillation, allowing it to re-engage when lock pin retracting pressure is removed.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
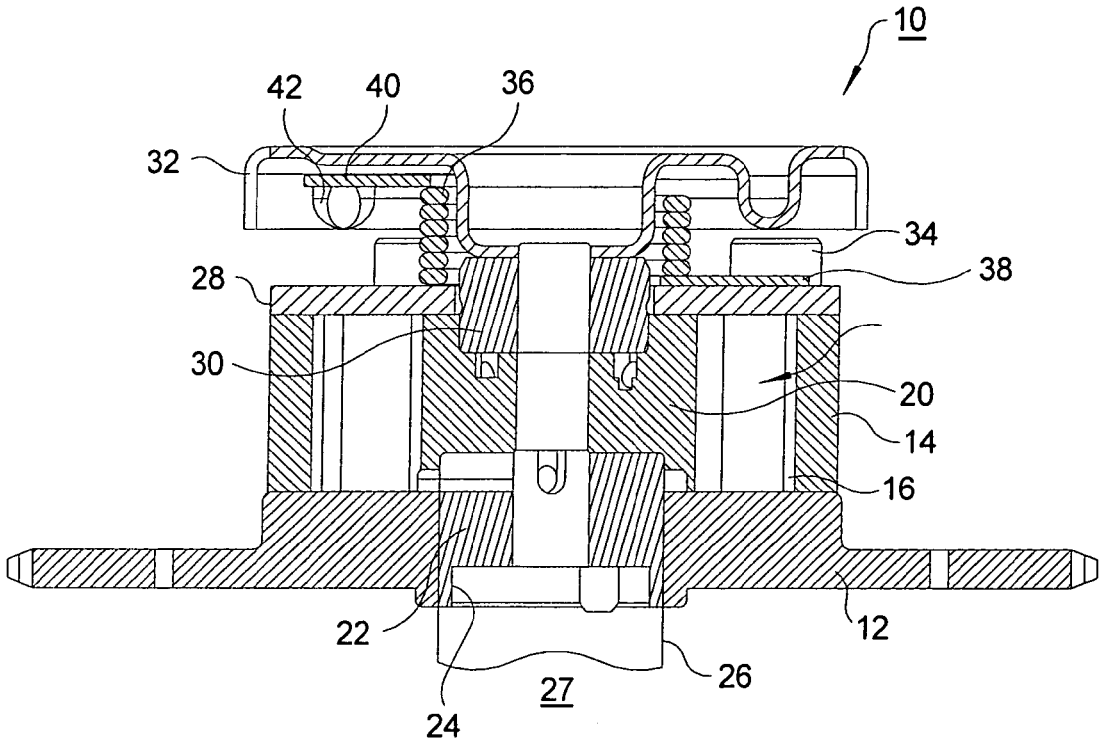
FIG. 1. (PRIOR ART)
FIG. 1 is an elevational cross-sectional view of a prior art vane-type camshaft phaser, showing entry of an engine camshaft into a rotor, and also showing an internal torsion bias spring for biasing the rotor to a fully retarded position within the stator.

Referring to FIG. 1, a typical prior art vane-type camshaft phaser 10 includes a pulley or sprocket 12 for engaging a timing chain or belt (not shown) operated by an engine crankshaft (not shown). A stator 14 is disposed against and rotates with pulley/sprocket 12. Stator 14 is provided with a central chamber 16 for receiving a rotor 18 having a hub 20. Hub 20 is provided with a recess 22 that is coaxial with a central bore 24 in sprocket 12, allowing access of an end of engine camshaft 26 into rotor hub 20 during mounting of phaser 10 onto an internal combustion engine 27 during assembly thereof. Central chamber 16 is closed by a cover plate 28, forming advance and retard chambers between the rotor and the stator in chamber 16. A rotor hub extension 30 is pressed into a recess in rotor hub 20 and extends rotatably through a central opening in cover plate 28. A target wheel 32 is mounted onto rotor hub extension 30 by an axial mounting bolt (not shown) that attaches phaser 10 to camshaft 26 during assembly of engine 27. Thus target wheel 32 turns with and is indicative of the rotational position of rotor 18 and camshaft 26. Cover plate 28 and stator 14 are secured to sprocket 12 via a plurality of binder screws 34 extending through stator 14 outside of chamber 16. A torsional bias spring 36 is disposed coaxially of rotor hub extension 30, having a first tang 38 anchored to stator 12 by engagement with the protruding head of a binder screw 34, and having a second tang 40 anchored to rotor 18 by engagement with a stop 42 on target wheel 32. Bias spring 36 is pre-loaded between the rotor and stator during assembly of phaser 10 to urge rotor 18 toward the full operational retard position within chamber 16.

Figure 2:
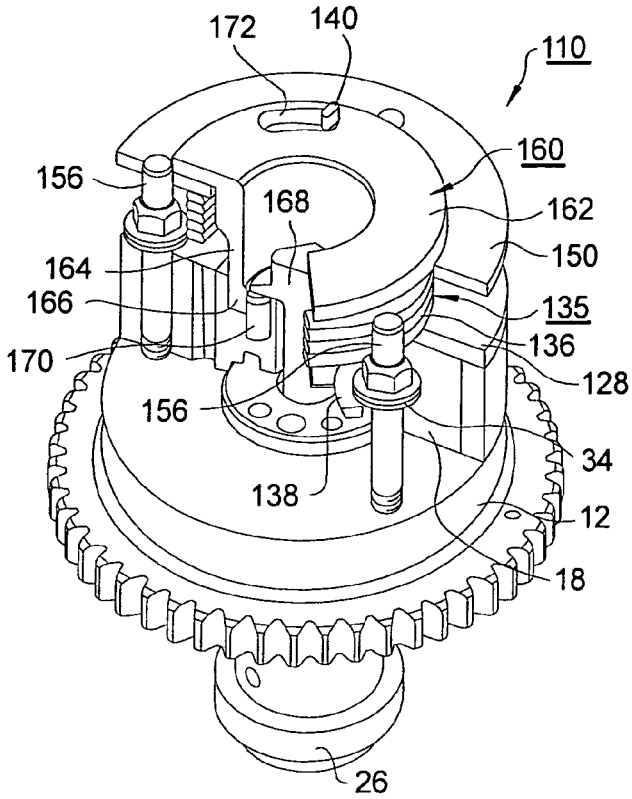
FIG. 2 is a cutaway isometric view of a camshaft phaser showing a toroidal bias spring system in accordance with the invention.
Figure 3:
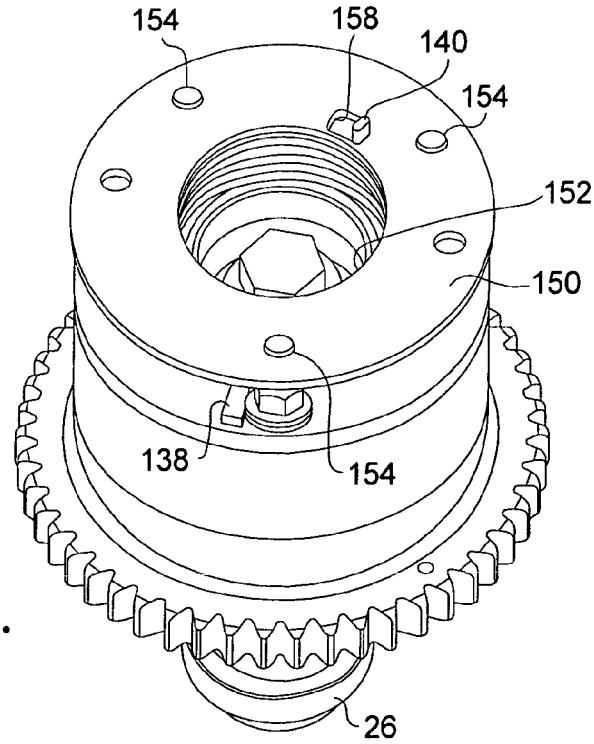
FIG. 3 is a full isometric view of the phaser and bias spring system shown in FIG. 2 with the spring retainer removed to show the anchor plate.
Figure 4:
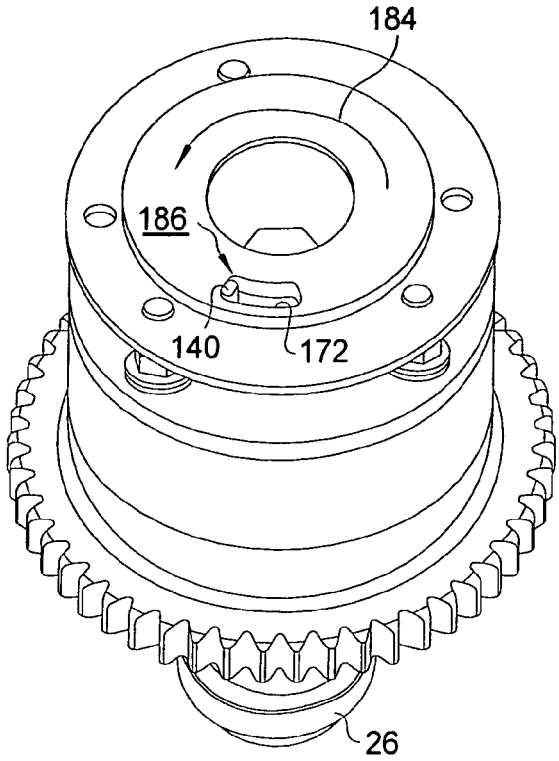
FIG. 4 is a full isometric view of the phaser and bias spring system shown in FIG. 2, showing the rotor in a valve-retard position with the bias spring engaged.

Referring now to FIGS. 2 through 4, a first embodiment 110 of an improved camshaft phaser in accordance with the invention includes an improved bias spring system 135 that replaces prior art torsional bias spring 36. In spring system 135, a torsion bias spring 136 is mounted on cover plate 128, and first spring tang 138 engages a bolt head 34 to ground the spring to sprocket 12, as in prior art phaser 10.

In a novel improvement over prior art phaser 10, spring 136 is captured axially by an annular anchor plate 150 having a central opening 152 and a plurality of holes 154 permitting anchor plate 150 to be slidably mounted onto bolt extensions 156. Anchor plate 150 is further provided with a slot 158 for receiving a second axially-extending spring tang 140. Slot 158 is formed such that tang 140 engages a first end of slot 158 corresponding to a full-retard position of rotor 18. Spring 136 may be formed to any convenient degree of spring force and configuration of windings such that when installed between cover plate 128 and anchor plate 150, spring 136 exerts any desired level of force bias against slot 156. Note that in this position, spring 136 is not engaged with rotor 18 and rather is grounded between two elements (bolt head 34 and anchor plate 150) both attached to stator 14. Note further that slot 158 is sufficiently extensive angularly that tang 140 can never engage the opposite end of slot 158 during operational motion of spring 136.

A spring retainer 160 comprises a first flange portion 162 extending radially over anchor plate 150, and a cylindrical portion 164 and second flange portion 166 extending through spring 136 and captured against rotor 18 by an assembly bolt 168. Preferably, spring retainer 160 is rotationally coupled to rotor 18 via pin 170, thereby correctly indexing slot 172 in spring retainer 160 to second spring tang 140 and slot 158.

In rotating with rotor 18, spring retainer 160 is freely rotatable past anchor plate 150. Note that the bias spring is coupled to the rotor via spring retainer 160 only when the rotor is in a retard position. Therefore, the phaser may be assembled without having the spring coupled to the rotor, thereby overcoming a rotor cocking problem inherent in prior art phasers and assuring reliable mounting of an assembled phaser onto a camshaft during engine assembly.

Figure 5:
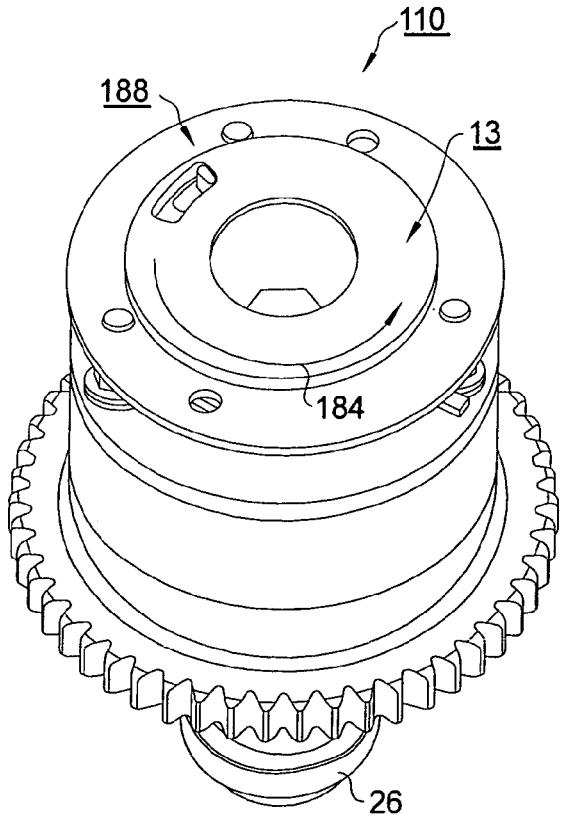
FIG. 5 a full isometric view of the phaser and bias spring system shown in FIG. 2, showing the rotor at a midpoint in its range of authority, suitable for locking to the stator.
Figure 6:
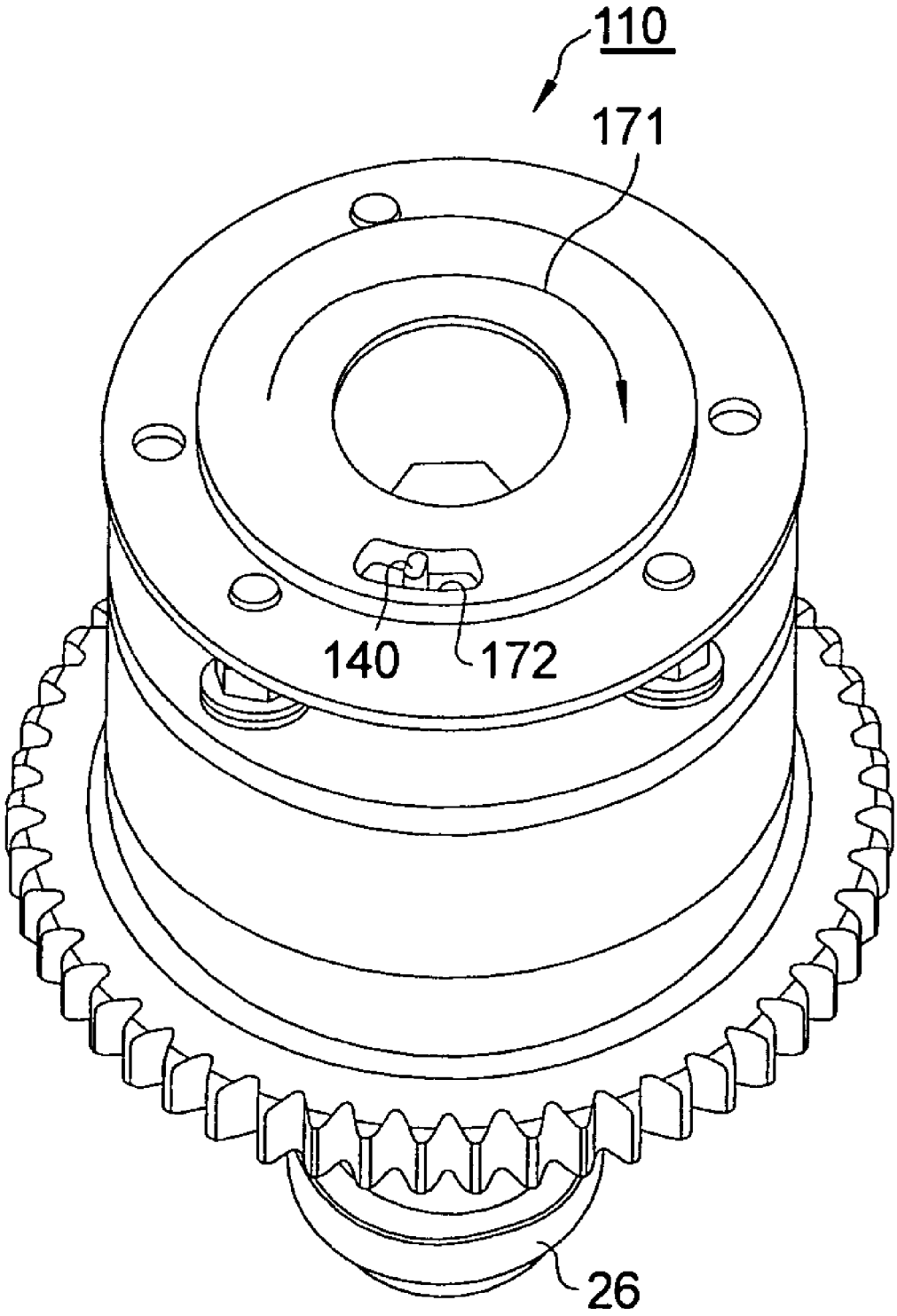
FIG. 6 a full isometric view of the phaser and bias spring system shown in FIG. 2, showing the rotor in an valve-advance position with the bias spring tang decoupled from the rotor.

Referring to FIGS. 4 through 6, in operation, during all phase-advance modes (FIG. 6) in valve timing-advance direction 171, an end of slot 172 is not engaged with second tang 140, and thus bias spring system 135 including spring 136 has no influence on motion of the rotor. However, in all positions of rotor retard phase angle (retard direction 180) from the position shown in FIG. 6, rotor motion is influenced by bias spring system 135 because second tang 140 is engaged by an end of slot 172. The position of slot 172 and second tang 140 shown in FIG. 5, wherein retard motion 184 of the rotor begins to be braked by bias spring system 135, corresponds to the locking position of an internal lock pin system (not visible but well known in the prior art) into the stator. As phase angle is commanded to retard past the intermediate locking position, tang 140 is engaged by the end of slot 172. Spring bias in the advance direction is transferred from anchor plate 150 to rotor 18, thus resisting further retardation of the rotor position. In normal operation, oil pressure against the rotor vanes can overcome the spring bias, moving the rotor to any desired retarded position 186, as shown in FIG. 4. However, as oil pressure falls, or is eliminated as by stopping the engine, spring 136, acting via spring retainer 160, returns rotor 18 to a predetermined position 188 (FIG. 5) intermediate in its range of authority wherein the rotor locking pin can engage the pin seat in the stator or sprocket. Because each valve event causes a torque reversal in camshaft 26, the opposing forces of cam torque and bias spring torque cause the lock pin to oscillate over its seat until it engages the seat. Thus, bias spring system 135 creates a time window wherein the lock pin and seat are roughly aligned for locking.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In a camshaft phaser for advancing and retarding the timing of valves in an internal combustion engine, wherein the phaser includes a rotor having a rotational range of authority within a stator, a cover plate disposed over the rotor and stator, and lock pin means for locking the rotor to the stator at an intermediate rotor position in the range of authority, the improvement comprising a bias spring system operationally disposed between said rotor and said stator for urging said rotor toward said intermediate position from only a portion of said range of authority, wherein said bias spring system includes a torsion spring grounded via a first tang to said stator, an anchor plate for capturing said torsion spring against said cover plate, and a spring retainer coupled to said rotor and rotatable past said anchor plate and having a slot formed such that an end of said slot engages a second tang of said spring whenever said rotor is urged into a predetemined portion of said range of authority from said intermediate position.

2. The improvement in accordance with claim 1 wherein said intermediate rotor position separates said range of authority into a phase-advance portion and a phase-retard portion, and wherein said bias spring system means is engageable with said rotor only within said phase-retard portion.

3. An internal combustion engine comprising a camshaft phaser for advancing and retarding the timing of valves, wherein said camshaft phaser includes a rotor having a rotational range of authority within a stator, lock pin means for locking said rotor to said stator at an intermediate rotor position in said range of authority, and a bias spring system operationally disposed between said rotor and said stator for urging said rotor toward said intermediate position from only a portion of said range of authority, wherein said bias spring system includes a torsion spring grounded via a first tang to said stator, an anchor plate for capturing said torsion spring against said cover plate, and a spring retainer coupled to said rotor and rotatable past said anchor plate and having a slot formed such that an end of said slot engages a second tang of said spring whenever said rotor is urged into a predetemined portion of said range of authority from said intermediate position.

* * * * *